US008833099B2

(12) United States Patent
Yoon

(10) Patent No.: US 8,833,099 B2
(45) Date of Patent: Sep. 16, 2014

(54) REFRIGERATOR

(75) Inventor: Jongsoo Yoon, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 309 days.

(21) Appl. No.: 13/185,792

(22) Filed: Jul. 19, 2011

(65) Prior Publication Data

US 2012/0017632 A1 Jan. 26, 2012

(30) Foreign Application Priority Data

Jul. 20, 2010 (KR) ..... 10-2010-0069805

(51) Int. Cl.
*F25D 23/00* (2006.01)
*F25B 39/02* (2006.01)

(52) U.S. Cl.
CPC ..... *F25D 23/006* (2013.01); *F25B 39/02* (2013.01)
USPC ..... 62/302; 62/465

(58) Field of Classification Search
USPC ..... 62/515, 516, 426, 452, 465, 466, 295.1, 62/295.4, 297, 448, 449, 403, 407, 295, 62/302; 165/78, 76; 248/200, 226.11, 248/309.1, 656, 669, 188.2, 188.4, 188.8; 312/408
See application file for complete search history.

(56) References Cited

U.S. PATENT DOCUMENTS

| | | | | |
|---|---|---|---|---|
| 3,712,078 | A * | 1/1973 | Maynard et al. | 62/448 |
| 7,185,509 | B2 * | 3/2007 | Lee et al. | 62/419 |
| 2005/0217301 | A1 * | 10/2005 | Iguchi et al. | 62/302 |
| 2009/0084117 | A1 * | 4/2009 | Czerwonky et al. | 62/77 |
| 2009/0308999 | A1 * | 12/2009 | Kim et al. | 248/299.1 |

FOREIGN PATENT DOCUMENTS

| | | | |
|---|---|---|---|
| CN | 1321304 | C | 6/2007 |
| EP | 1 681 525 | A2 | 7/2006 |
| JP | 2000-186880 | A | 7/2000 |

OTHER PUBLICATIONS

Chinese Office Action dated Aug. 30, 2013 for Application No. 201110242063.4, with English Translation, 18 pages.

* cited by examiner

*Primary Examiner* — Allana Lewin
*Assistant Examiner* — Kun Kai Ma
(74) *Attorney, Agent, or Firm* — Fish & Richardson P.C.

(57) ABSTRACT

A refrigerator is disclosed, which is able to mount an evaporator in a cool air generating chamber more easily for a short time. The refrigerator comprises a main body provided with a storage chamber; a cool air generating chamber provided above the main body and connected with the storage chamber; an evaporator provided inside the cool air generating chamber; and a support portion provided in the ceiling inside the cool air generating chamber and variably provided in a mounting direction of the evaporator to support the evaporator.

19 Claims, 4 Drawing Sheets

【Fig. 3

REFRIGERATOR

This application claims the benefit of the Korean Patent Application No. 10-2010-0069805, filed on Jul. 20, 2010 which is hereby incorporated by reference as if fully set forth herein.

BACKGROUND OF THE INVENTION

1. Field of the Invention

The present invention relates to a refrigerator, and more particularly, to a refrigerator that is able to mount an evaporator more easily if a cool air generating chamber is provided above a main body.

2. Discussion of the Related Art

A refrigerator is a home appliance that stores food at a freezing state and a refrigerating state by using a refrigerant cycle.

Specifically, the refrigerator comprises a main body provided with a storage chamber such as a freezing chamber or a refrigerating chamber, and a cool air generating chamber provided in the main body and connected with the storage chamber, wherein an evaporator is received in the cool air generating chamber.

The cool air generating chamber can be located at the rear of the storage chamber or above the storage chamber. In particular, if the cool air generating chamber is located above the storage chamber, a user had to fix the evaporator by using a fixing member such as a bolt after lifting the evaporator and locating it in the cool air generating chamber.

However, the refrigerator has problems in that it is inconvenient to mount and fix the evaporator due to a narrow inner space of the cool air generating chamber and, as a result, it takes much assembly time.

SUMMARY OF THE INVENTION

Accordingly, the present invention is directed to a refrigerator that substantially obviates one or more problems due to limitations and disadvantages of the related art.

An object of the present invention is to provide a refrigerator that is able to mount an evaporator in a cool air generating chamber more easily for a short time.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator according to the present invention comprises a main body provided with a storage chamber; a cool air generating chamber provided above the main body and connected with the storage chamber; an evaporator provided inside the cool air generating chamber; and a support portion provided in the ceiling inside the cool air generating chamber and variably provided in a mounting direction of the evaporator to support the evaporator.

As described above, the refrigerator according to the present invention has advantages as follows.

The evaporator can easily be mounted in a narrow space of the cool air generating chamber.

In other words, since a shape of the support portion is not fixed but deformed in a mounting direction of the evaporator, the mounting portion of the evaporator is arranged in the support portion and slid. Then, since the mounting portion of the evaporator and the support portion can be fixed simultaneously by a fixing member, their excellent fixing state can be maintained and the evaporator can be mounted more easily and quickly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
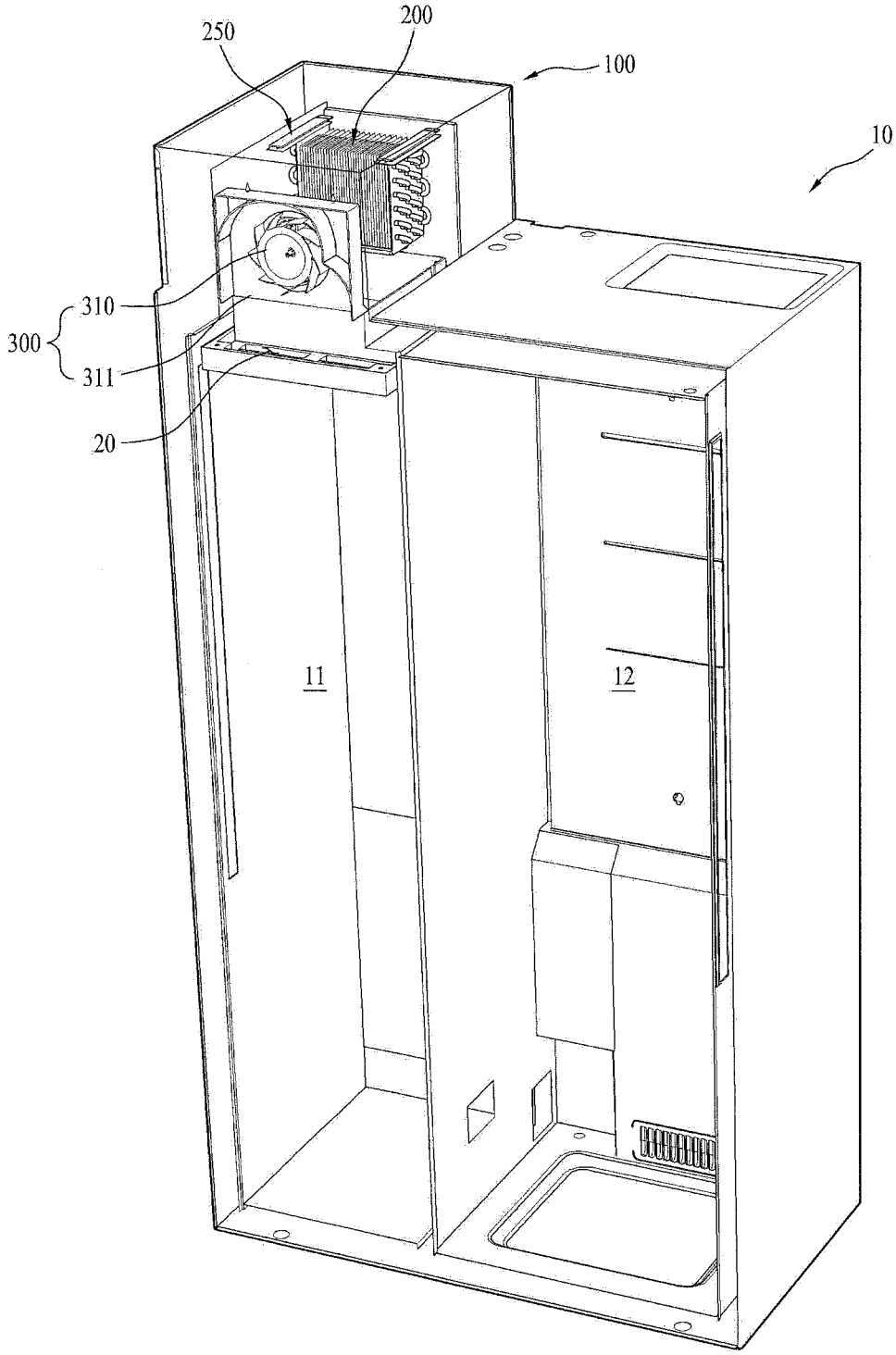
FIG. 1 is a perspective view illustrating a refrigerator according to the present invention.

As shown in FIG. 1, a refrigerator according to the present invention includes a main body provided with a storage chamber such as a freezing chamber 11 or a refrigerating chamber 12, and a cool air generating chamber 100 provided above the main body 10 and connected with the freezing chamber.

The cool air generating chamber 100 is provided to be projected towards an upward direction of the main body 10. However, the cool air generating chamber 100 may be provided towards the refrigerating chamber 12.

An evaporator 200 and a cool air fan unit 300 are provided inside the cool air generating chamber 100.

The evaporator 200 is caught in a support portion 250 arranged in the ceiling inside the cool air generating chamber 100. A detailed coupling structure of the support portion 250 and the evaporator 200 will be described later.

The cool air fan unit 300 provided at the front of the evaporator 200 includes a cool air fan 310 and a fan housing 311 surrounding the cool air fan 310.

An outlet 20 is provided at the front of the evaporator 200 and guides the cool air, which has passed through the evaporator 200 through a rotation action of the cool air fan 310, to move to the freezing chamber.

A structure of the evaporator 200 and the support portion 250 and a process of mounting the evaporator 200 in the support portion 250 will be described with reference to FIG. 2.

First of all, the evaporator 200 includes a body portion 210, and a plate shaped mounting portion 220 provided at both sides of the body portion 210.

It is preferable that the mounting portion 220 is configured in a rectangular shaped plate of which vertical length is remarkably longer than a horizontal length.

Preferably, the body portion 210 includes a refrigerant drain pipe and a cooling fan, wherein a refrigerant flows in the refrigerant pipe, and the cooling fan is attached to the cooling fan.

The support portion 250 is fixedly arranged in the ceiling inside the cool air generating chamber 100.

The support portion 250 includes a first support portion 260 fixed to the ceiling inside the cool air generating chamber 100, and a second support portion 270 provided with one end and the other end, wherein the other end of the second support portion 270 can be moved up and down using the one end as a fixing end in a state that the first support portion 260 is connected with the one end of the second support portion 270.

In other words, the support portion 250 is provided variably in a bendable shape of a certain level. This is to easily mount the evaporator 200.

In other words, if the second support portion 270 is pulled downwardly, it is inclined downwardly.

In a state that the second support portion 270 is arranged obliquely, the mounting portion 220 provided in the evaporator 200 is inserted into the second support portion 270.

In other words, in order to mount the evaporator 200, an assembly worker moves the evaporator 200 in an oblique direction in a state that he/she holds the evaporator 200. This is easier than the assembly method according to the related art. In this way, the support portion 250 is bent towards the mounting direction of the evaporator 200 and the second support portion 270 is arranged downward obliquely. In this case, assembly efficiency can be increased.

The second support portion 270 into which the mounting portion 220 is inserted will be described.

The second support portion 270 has a "ㄷ" shaped section, and includes loading portions 271 and 273 up and down spaced apart from each other to form a loading space 275 into which the mounting portion 220 is inserted, and a sidewall portion 272 provided at one side of the loading portions 271 and 273.

The loading portions 271 and 273 include the first loading portion 271, and the second loading portion 273 arranged below the first loading portion 271 and spaced apart from the first loading portion 271.

In the meantime, the sidewall portion 272 is provided to connect sidewalls of the first loading portion 271 and the second loading portion 273 with each other.

Accordingly, the loading space 275 is formed by the sidewall portion 272 and the first and second loading portions 271 and 273.

It is preferable that an opposite side of the sidewall portion 272 is provided with an opening portion to allow one side of the mounting portion 220 to pass through the opening portion.

This is because that the width of the second support portion 270 is narrower than that of the mounting portion 220.

The support portion 250 includes support portions in pairs, which are arranged in parallel in the ceiling of the cool air generating chamber in a state that they are spaced apart from each other. At this time, it is preferable that the opening portions of the support portions are arranged to face each other.

This is to allow the mounting portions 220 provided in pairs to be supported in the support portion 250 while passing through the opening portions of the respective support portions 250 and the loading space 275.

A first through hole 221 and a second through hole 274 are respectively provided in the mounting portion 220 and the first and second loading portions 271 and 273. A predetermined fixing member 280 (see FIG. 4) is fixedly inserted into the ceiling of the cool air generating chamber 100 (see FIG. 1) by passing through the first though hole 221 and the second through hole 274.

In this case, the support portion 250 includes support portions in pairs spaced apart from each other. This is to arrange the support portions to correspond to the arrangement state of the mounting portions 220 provided in the evaporator 200.

Accordingly, the support portion 250 arranged at the left side and the support portion 250 arranged at the right side are respectively coupled to their corresponding mounting portions 220 to support the evaporator 220.

In the mean time, the first support portion 260 is fixedly coupled to another fixing member 261 for fixing the first support portion 260 to the ceiling of the cool air generating chamber 100.

In other words, the first support portion 260 is fixed at a location different from that of the second support portion 270, and is connected with one end of the second support portion 270 to serve as a reference point of movement of the second support portion 270 if the second support portion 270 is arranged obliquely or horizontally.

Figure 2:
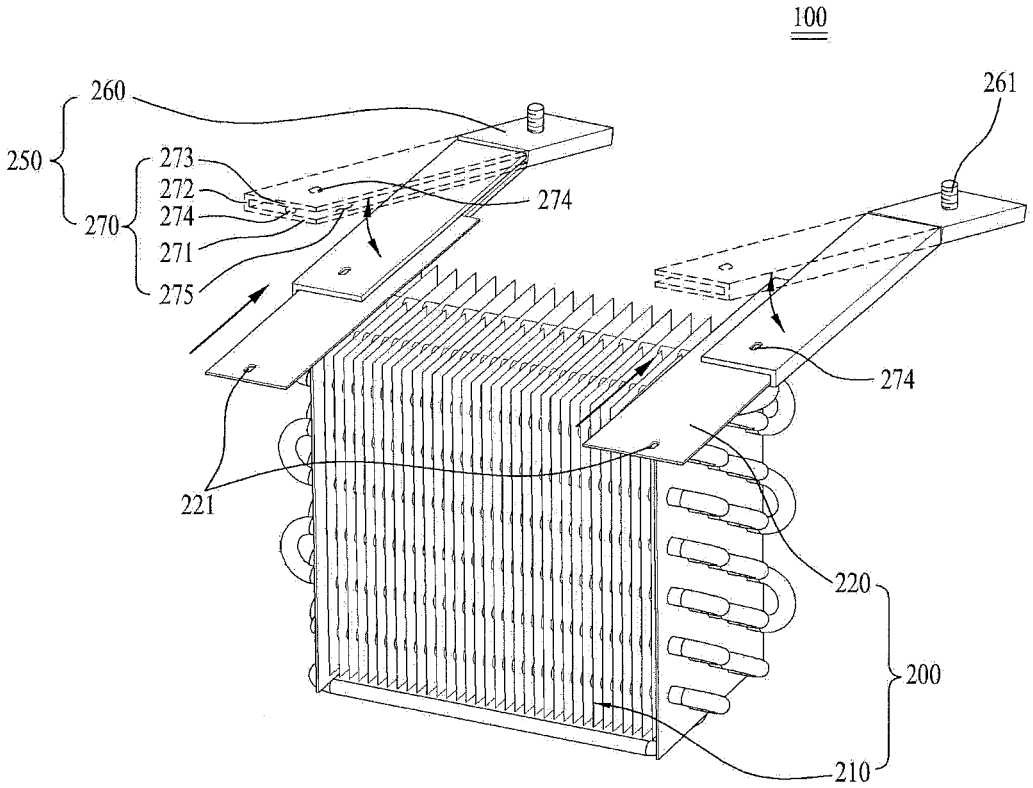
FIG. 2 is a view illustrating a state that an evaporator is caught in a support portion.

In FIG. 2, the assembly worker can slide the mounting portion 220 towards the rear side by arranging the mounting portion 220 in the loading space 275 between the first and second loading portions 271 and 273 of the second support portion 270.

The mounting portion 220 is moved towards the first support portion 260 fixed in the ceiling of the cool air generating chamber 100 by passing through the front end of the second support portion 270.

Figure 3:
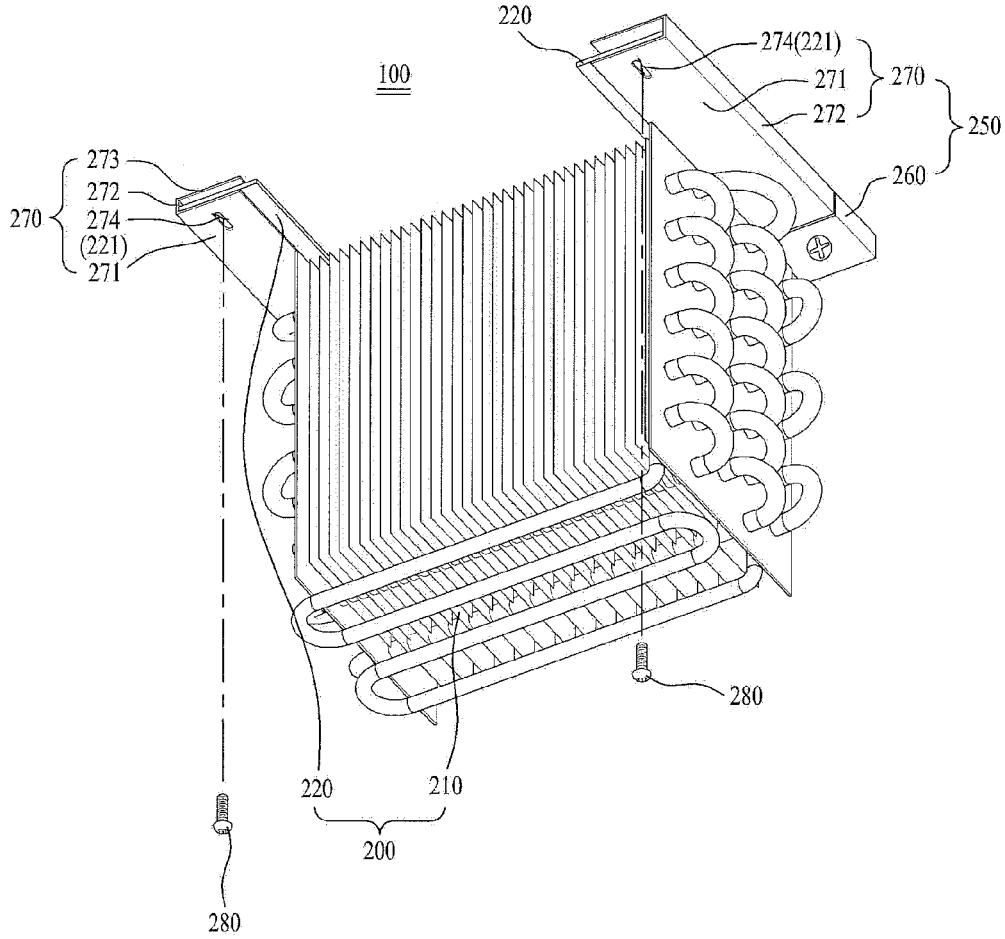
FIG. 3 is a view illustrating a state that an evaporator is coupled to a support portion.

If the evaporator 200 is pushed upwardly, the state of FIG. 3 is obtained.

In other words, the second support portion 270 arranged obliquely with respect to the first support portion 260 in FIG. 2 has a '-' shape together with the first support portion 260.

In this state, if the fixing member 280 is fixedly inserted into the first and second through holes 221 and 274, the fixing member 280 passes through the first and second through holes 221 and 274 and is coupled to the ceiling of the cool air generating chamber 100 (see FIG. 1).

In this way, the mounting portion 220 of the evaporator 200 and the second support portion 270 can be fixed to the ceiling of the cool air generating chamber 100 by the fixing force of the fixing member 280.

Since the first support portion 260 is fixed to the ceiling of the cool air generating chamber 100 as described above, the location of the evaporator 200 can be maintained in a state that the evaporator 200 is fixed to the lower portion of the ceiling of the cool air generating chamber 100 in accordance with the location fixation of the mounting portion 220 and the first and second support portions 260.

In the mean time, in order to detach the evaporator 200 from the cool air generating chamber 100 by removing the evaporator 200 from the support portion 250, the detachment action is performed in the reverse order of the aforementioned mounting order.

Figure 4:
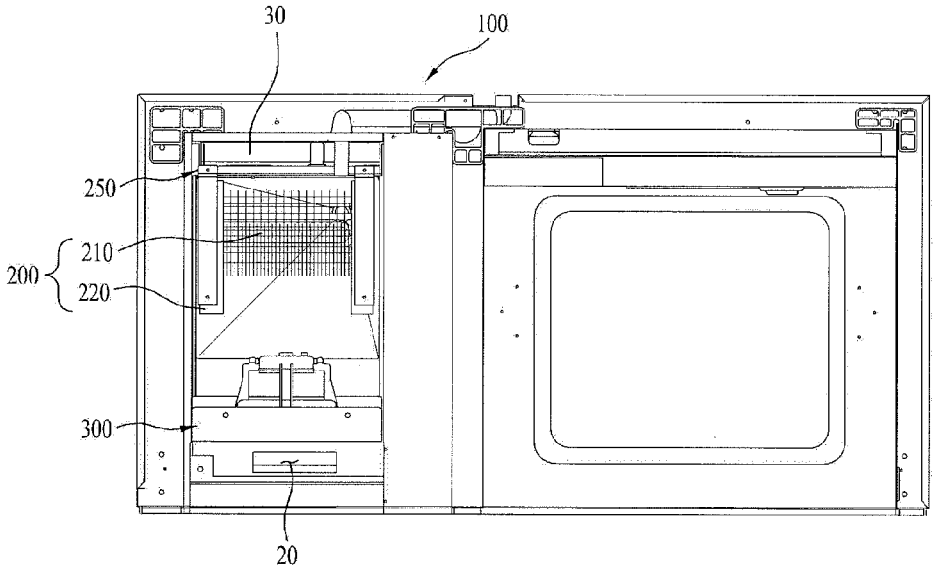
FIG. 4 is a plane view illustrating a refrigerator according to the present invention.

As shown in FIG. 4, the evaporator 200 is fixed into the cool air generating chamber 100 in a state that it is located at the center of the rear side of the cool air generating chamber 100.

The support portions 250 are arranged in parallel to be spaced apart from each other at both sides inside the cool air generating chamber 100, and the mounting portion 220 of the evaporator 200 is inserted into the support portion 250, whereby the body portion 210 of the evaporator 200 is maintained as it is.

The cool air fan unit 300 is provided at the front of the evaporator 200.

If the cool air fan unit 300 is driven, the air in the storage chamber is moved upwardly and passes through the inlet 30 provided at the rear of the evaporator 200. Then, the air again flows into the storage chamber by sequentially passing through the evaporator 2001, the cool air fan unit 300, and the outlet 20.

It will be apparent to those skilled in the art that the present invention can be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A refrigerator comprising: a main body provided with a storage chamber; a cool air generating chamber provided on a top surface of the main body and provided with an inlet and an outlet that enable the cool air generating chamber to communicate with the storage chamber; an evaporator disposed within the cool air generating chamber; and a tiltable support member mounted beneath a ceiling of the cool air generating chamber and having a first support portion that is fixed and a second support portion that tilts relative to the first support portion wherein the evaporator comprises: a body portion including a refrigerant pipe; and a mounting portion provided on the body portion and slidably mounted in the second support portion of the support member, wherein the first support portion is fixed to the ceiling of the cool air generating chamber, wherein the second support portion has a first end and a second end, the first end being connected with the first support portion, and the second end being configured to tilt up and down such that the second end moves toward and away from the ceiling of the cool air generating chamber, wherein the mounting portion of the evaporator is slidably inserted into and coupled to the second support portion, and wherein a width of the second support portion is narrower than a width of the mounting portion such that the mounting portion extends out of the second support portion in a width direction when the mounting portion has been slid into the second support portion.

2. The refrigerator as claimed in claim 1, wherein the support member includes support members in pairs, which are spaced apart from each other, and the mounting portion includes mounting portions provided in pairs above the body portion and spaced apart from each other to correspond to the arrangement state of the support members.

3. The refrigerator as claimed in claim 1, wherein the second support portion is arranged downward obliquely with respect to the first support portion if the evaporator is mounted on or detached from the second support portion, and if the evaporator is moved upwardly in a state that the evaporator is coupled to the second support portion, the second support portion forms a same plane shape together with the first support portion.

4. The refrigerator as claimed in claim 1, wherein the second support portion includes loading portions up and down spaced apart from each other to form a loading space into which the mounting portion is loaded, and a sidewall portion provided at one side of the loading portions, and the mounting portion is inserted into the loading space and loaded in the loading portions.

5. The refrigerator as claimed in claim 4, wherein the loading portions include a first loading portion and a second loading portion arranged below the first loading portion and spaced apart from the first loading portion, an opposite side of the sidewall portion is opened, and the first and second loading portions and the sidewall portion form a rectangular pipe shaped section with an open inner side surface, the loading portions having a width wider than that of the loading space.

6. The refrigerator as claimed in claim 3, further comprising:

a first through hole formed in the mounting portion;

a second through hole formed in the second support portion; and a fixing member fixed to the ceiling of the cool air generating chamber by passing through the first and second through holes.

7. The refrigerator as claimed in claim 6, wherein the first through hole is formed at the front end of the mounting portion, and the second through hole is formed at the front end of the second support portion.

8. The refrigerator as claimed in claim 6, wherein the first support portion is fixed to the ceiling of the cool air generating chamber by a predetermined fixing member.

9. The refrigerator as claimed in claim 4, wherein the mounting portion is provided in a plate shape, and is inserted into the loading space by sliding movement and maintains surface contact with the loading portions.

10. The refrigerator as claimed in claim 9, wherein the mounting portion is provided in a plate shape of which vertical length is longer than a horizontal length.

11. The refrigerator as claimed in claim 1, wherein the tilting portion of the tiltable support member is configured to tilt downwardly from the fixing portion of the tiltable support member such that the tilting portion of the tiltable support member is inclined downwardly from the fixing portion of the tiltable support member.

12. The refrigerator as claimed in claim 1: wherein the second support portion includes a first loading portion and a second loading portion spaced apart from the first loading portion to define a loading space into which the mounting portion slides, and a sidewall portion provided at one side of the first and second loading portions, wherein an opposite side of the sidewall portion is opened, wherein a first through hole is located in the mounting portion, wherein a second through hole is located in the first and second loading portions, wherein the evaporator is configured to be mounted to the tiltable support member based on the second support portion being tilted downward from the ceiling of the cold air generating chamber to a first orientation that is angled downward from the first support portion, the mounting portion being slid into the loading space when the second support portion is tilted to the first orientation, the second support portion being tilted upward toward the ceiling of the cold air generating chamber to a second orientation that is angled parallel to the first support portion, and, in the second orientation, the evaporator is secured to the ceiling of the cold air generating chamber by a fixing member that passes through the first through hole and the second through hole, and wherein the mounting portion extends outside of the loading space through the opened opposite side of the second support portion when the mounting portion is mounted to the second support portion.

13. A refrigerator comprising: a main body provided with a storage chamber; a cool air generating chamber provided on a top surface of the main body and provided with an inlet and an outlet that enable the cool air generating chamber to communicate with the storage chamber; a tiltable support member mounted beneath a ceiling of the cool air generating chamber and having a first support portion that is fixed and a second support portion that tilts relative to the first support portion; an evaporator disposed within the cool air generating chamber; and a mounting portion provided on the evaporator and slidably mounted in the second support portion of the support member, the mounting portion being provided in a plate shape, wherein the first support portion is fixed to the ceiling of the cool air generating chamber, and the mounting portion is slidably inserted into the second support portion, the second support portion being arranged to tilt between an orientation that is downward obliquely with respect to the first support portion and an orientation maintained in a parallel state with the first support portion, and wherein a width of the second support portion is narrower than a width of the mounting portion such that the mounting portion extends out of the second support portion in a width direction when the mounting portion has been slid into the second support portion.

14. The refrigerator as claimed in claim 13, wherein the mounting portion is provided with mounting portions in pairs, which are spaced apart from each other in parallel above the evaporator, and the support member is provided with support members in pairs spaced apart from each other in the ceiling of the cool air generating chamber to correspond to the mounting portions.

15. The refrigerator as claimed in claim 13, wherein the second support portion includes loading portions forming a loading space into which the mounting portion is inserted, and a sidewall portion, the loading portions including a first loading portion and a second loading portion arranged below the first loading portion and spaced apart from the first loading portion, and the sidewall portion being arranged to connect a side end of the first loading portion with a side end of the second loading portion.

16. The refrigerator as claimed in claim 13, further comprising an opening portion provided in the second support portion and provided at an opposite side of the sidewall portion, the second support portion having a rectangular pipe shaped section with an open inner side surface.

17. The refrigerator as claimed in claim 16, wherein the first support portion includes an opening portion arranged to face the opening portion of the second support portion.

18. The refrigerator as claimed in claim 13, wherein the second support portion is arranged downward obliquely with respect to the first support portion if the evaporator is mounted on or detached from the second support portion, and if the evaporator is moved upwardly in a state that the evaporator is coupled to the second support portion, the second support portion forms a same plane shape together with the first support portion.

19. The refrigerator as claimed in claim 13, further comprising: a first through hole formed in the mounting portion; a second through hole formed in the second support portion; and a fixing member fixed to the ceiling of the cool air generating chamber by passing through the first and second through holes, wherein the first through hole is formed at the front end of the mounting portion, and the second through hole is formed at the front end of the second support portion.

* * * * *